US006388400B1

(12) United States Patent
Noh

(10) Patent No.: US 6,388,400 B1
(45) Date of Patent: May 14, 2002

(54) ADMINISTRATION DEVICE FOR LIGHTING FIXTURES

(75) Inventor: Shi Youl Noh, Seoul (KR)

(73) Assignee: Boam R & D Co., Ltd., Kyonggi-do (KR)

( * ) Notice: Subject to any disclaimer, the term of this patent is extended or adjusted under 35 U.S.C. 154(b) by 0 days.

(21) Appl. No.: 09/512,271

(22) Filed: Feb. 24, 2000

(51) Int. Cl.[7] ..... H05B 37/00

(52) U.S. Cl. ..... 315/318; 315/312; 315/360; 315/294; 315/DIG. 4

(58) Field of Search ..... 315/291, 209 R, 315/294, 307, 297, 312, 318, 360, 362, DIG. 4

(56) References Cited

U.S. PATENT DOCUMENTS 5,055,746 A * 10/1991 Hu et al. ..... 315/291
5,066,896 A * 11/1991 Bertenshaw et al. ..... 315/291
5,128,594 A * 7/1992 Watanabe et al. ..... 315/294
6,107,755 A * 8/2000 Katyl et al. ..... 315/307
6,218,787 B1 * 4/2001 Murcko et al. ..... 315/194

* cited by examiner

*Primary Examiner*—Haissa Philogene
(74) *Attorney, Agent, or Firm*—Fleshner & Kim, LLP

(57) ABSTRACT

A lighting administration device of the present invention has a main controller which converts a dimming signal from a remote controller into coded signals that are used to control a plurality of decoders. The decoders may be connected to the main controller in series, using a data line. A plurality of ballasts are connected to respective decoders in series. The decoders are each assigned an address, and each coded signal generated by the main controller bears the address of a corresponding decoder. The main controller may also have a timer function that causes the power to be shut off are a predetermined period of time elapses.

18 Claims, 1 Drawing Sheet

ADMINISTRATION DEVICE FOR LIGHTING FIXTURES

BACKGROUND OF THE INVENTION

1. Field of the Invention

The present invention relates to an administration device for lighting fixtures.

2. Description of the Related Art

In the prior art, a code decoder is attached to each ballast of a lighting fixture, causing a high unit cost of production. That is, each ballast has a corresponding decoder, the lighting fixture is administrated via a signal decoder in the decoder, and this results in the high unit cost of production.

SUMMARY OF THE INVENTION

Accordingly, an object of the present invention is to provide an administration device for lighting fixtures which can administrate several lighting fixtures by one controller and one remote controller and thus lower the unit cost of production.

To achieve the above object, the administration device of the present invention has a main controller which converts a dimming signal to a coded signal to control a plurality of decoders. The plurality of decoders are connected to the main controller in series and a plurality of ballasts are connected to respective decoders in series. Each decoder has a unique address, and the main controller sends coded signals, with address information, to the decoders. The main controller may also have a timer function.

BRIEF DESCRIPTION OF THE DRAWINGS

The foregoing and other objects, features and advantages of the present invention will become more apparent from the following detailed description when taken in conjunction with the accompanying drawing in which.

DETAILED DESCRIPTION OF THE PREFERRED EMBODIMENT

Figure 1:
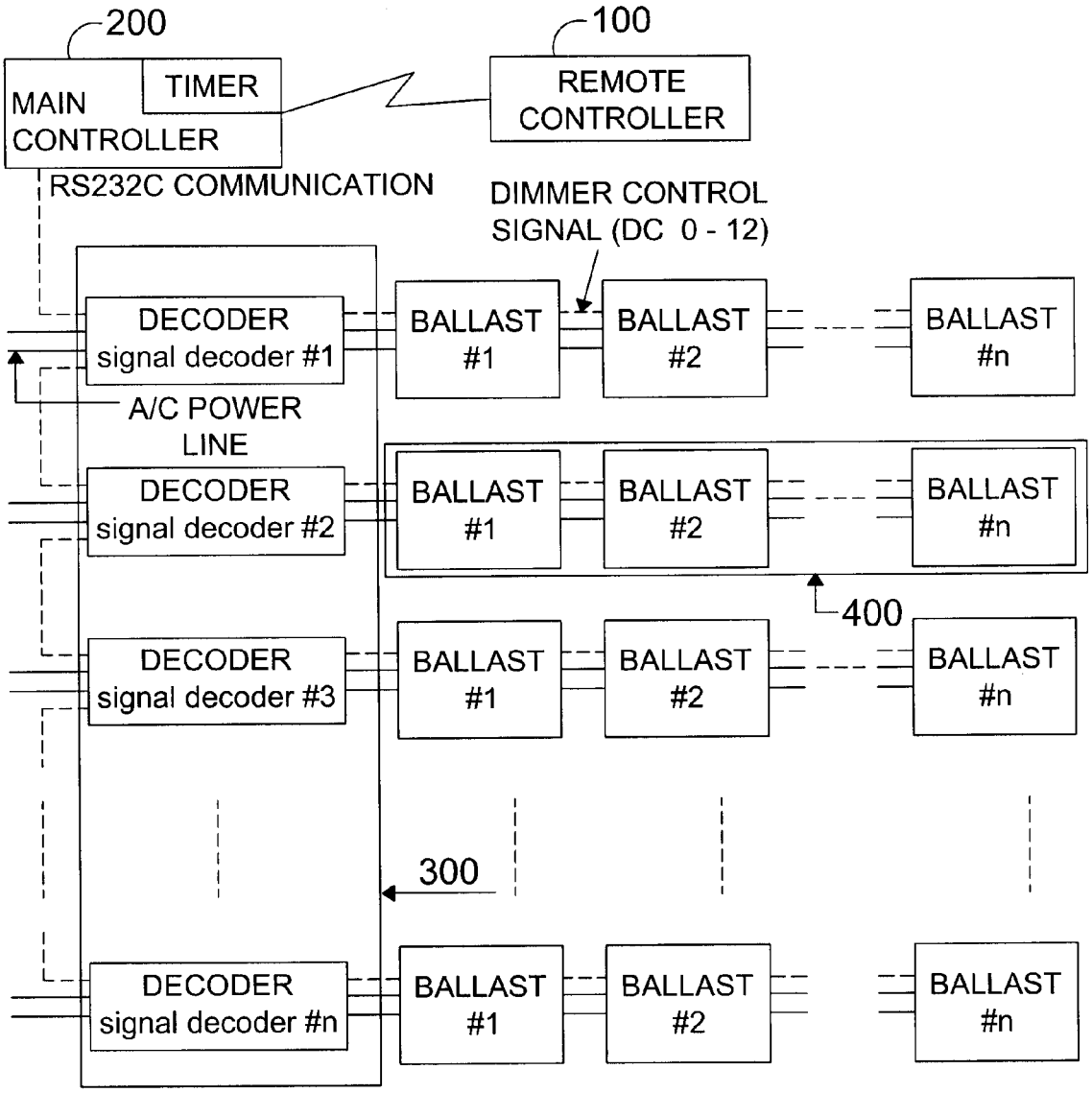
FIG. 1 is a schematic diagram showing an administration device for lighting fixtures.

The present invention will be described with reference to FIG. 1. The present invention has a main controller 200, a remote controller 100, a plurality of decoders 300 and a plurality of ballasts 400.

The main controller 200 converts dimming signals to coded signals and outputs them to the decoders 300.

The coded signals are transmitted to each decoder by an RS232C communication method. Each of the coded signals has the address of a corresponding decoder, so that the coded signal can be transmitted to a corresponding decoder by using the address.

That is, if an address is allotted to each decoder, and the coded signals are transmitted to the appropriate addresses, dimming signals can be transmitted from the main controller to the appropriate decoders. With this method, it is possible to control the dimming signal by the decoder.

The main controller 200 is controlled by the remote controller 100. In addition, the main controller has a timer function, so that it can automatically turn the power on or off after the lapse of a predetermined time.

The decoders 300 are connected to the main controller 200 in series and the number of the decoders is not limited. Each decoder is connected to an A/C power and to a dimming control line which is connected to the main controller 200 by the RS232C communication method. The dimming control line is operated on the direct current 0V–12V.

Each decoder has a noise filter, a code signal decoder and a power relay unit. The decoder decodes the coded signal received from the main controller 200 and converts it to the signal which can dimming-control the ballasts.

In this case, the dimming control signal is generally operated on the direct current 0V–12V and the power relay unit can be turned on or off according to the dimming control signal.

It is possible to connect a plurality of ballasts to one code signal decoder.

With this function, the light fixtures in a large sized building can be controlled by one controller and one remote controller.

Accordingly, the present invention can administrate a plurality of lighting fixtures by one controller and one remote controller, thus lowering the unit cost of production.

What is claimed is:

1. An administration device for lighting fixtures, comprising:

a main controller which converts a dimming signal into coded signals that are used to control a plurality of decoders;

a plurality of decoders connected to said main controller such that the decoders can receive and interpret the coded signals; and a plurality of ballasts connected to each decoder, wherein each of the plurality of decoders is assigned a unique address, and wherein each of the coded signals generated by the main controller includes an address of a corresponding decoder.

2. The administration device of claim 1, wherein each of the plurality of decoders is configured to act only in response to coded dimming signals that include its unique address.

3. The administration device of claim 1, wherein the coded signals have a RS232C communication format.

4. The administration device of claim 1, wherein the plurality of decoders are connected to the main controller in series.

5. The administration device of claim 4, wherein the plurality of decoders are connected to the main controller according to a RS232C communication format.

6. The administration device of claim 1, wherein the plurality of ballasts connected to each decoder are connected in series.

7. The administration device of claim 1, wherein the main controller has a timer function that is configured to cause the decoders to shut off power after a predetermined period of time elapses.

8. The administration device of claim 1, further comprising a remote controller connected to the main controller, wherein the remote controller generates a dimming signal that is sent to the main controller.

9. A system for controlling a plurality of lighting devices, comprising:

a controller configured to generate coded dimming signals, wherein each coded dimming signal includes dimming information and an address of a decoder; and a plurality of decoders configured to receive and interpret the coded dimming signals generated by the controller, wherein each of the plurality of decoders is assigned a unique address, and wherein each decoder is connected to at least one ballast configured to control a lighting device.

10. The system of claim 9, wherein each of the plurality of decoders is configured to act only in response to coded dimming signals that include its unique address.

11. The system of claim 9, wherein each of the plurality of decoders is connected to a plurality of ballasts that are configured to control lighting devices.

12. The system of claim 11, wherein each decoder is connected to a plurality of ballasts in a series fashion.

13. The system of claim 9, wherein the controller is configured to generate coded dimming signals in a RS232C communications format.

14. The system of claim 13, wherein the plurality of decoders are configured to receive and act on coded dimming signals that are in a RS232C communications format.

15. The system of claim 9, wherein the plurality of decoders are connected to the controller in a series fashion.

16. The system of claim 9, further comprising a remote controller that is configured to generate a control signal, wherein the controller is configured to receive the control signal and to generate coded dimming signals based on the control signal.

17. The system of claim 9, wherein the coded dimming signals generated by the controller can be used to individually control each of the plurality of decoders so that one decoder can operate at a first dimming level while a second decoder operates at a second dimming level.

18. The system of claim 17, wherein each of the plurality of decoders is connected to a plurality of ballasts configured to control lighting devices, and wherein each ballast will operate a lighting device based on the coded dimming signals addressed to the decoder to which it is connected.

* * * * *